US008418883B2

(12) United States Patent
Sharp et al.

(10) Patent No.: US 8,418,883 B2
(45) Date of Patent: Apr. 16, 2013

(54) PACKET FOR VISCOUS MATERIAL AND KIT

(75) Inventors: Phillip Neal Sharp, Sunnyvale, CA (US); Sven Newman, Burlingame, CA (US); David C. Thomsen, San Mateo, CA (US); Anita G. Mooy, Charlotte, NC (US); Jeffrey J. Davis, Cornelius, NC (US)

(73) Assignee: Momentive Performance Materials, Albany, NY (US)

( * ) Notice: Subject to any disclaimer, the term of this patent is extended or adjusted under 35 U.S.C. 154(b) by 572 days.

(21) Appl. No.: 12/236,555

(22) Filed: Sep. 24, 2008

(65) Prior Publication Data

US 2009/0071979 A1 Mar. 19, 2009

Related U.S. Application Data

(63) Continuation-in-part of application No. 11/613,661, filed on Dec. 20, 2006, and a continuation-in-part of application No. 12/200,376, filed on Aug. 28, 2008.

(60) Provisional application No. 60/969,232, filed on Aug. 31, 2007.

(51) Int. Cl.
*B65D 35/28* (2006.01)

(52) U.S. Cl.
USPC ..... 222/103; 222/107

(58) Field of Classification Search ..... 222/107, 222/95, 92, 93, 103, 105, 541.1, 541.6, 541.9; 206/223, 229
See application file for complete search history.

(56) References Cited

U.S. PATENT DOCUMENTS

| | | | | |
|---|---|---|---|---|
| 2,390,822 A | | 12/1945 | Wren | 222/572 |
| 2,723,779 A | | 11/1955 | Parker et al. | 222/104 |
| 2,878,967 A | | 3/1959 | Duke | 222/107 |
| 3,354,924 A | | 11/1967 | Birrell et al. | 220/666 |
| 3,635,376 A | | 1/1972 | Hellstrom | 222/107 |
| 3,986,640 A | | 10/1976 | Redmond | |
| 4,148,417 A | | 4/1979 | Simmons | |
| 4,236,652 A | | 12/1980 | Beguhn | |
| 4,611,715 A | * | 9/1986 | Redmond | 206/484 |
| 4,671,026 A | | 6/1987 | Wissinger | |

(Continued)

FOREIGN PATENT DOCUMENTS

| | | | |
|---|---|---|---|
| JP | 2001-018989 | | 1/2001 |
| JP | 2001018989 A | * | 1/2001 |
| WO | WO92/09494 | | 6/1992 |

OTHER PUBLICATIONS

JP 2001-018989 English translation.*

(Continued)

*Primary Examiner* — Paul R Durand
*Assistant Examiner* — Robert Nichols, II
(74) *Attorney, Agent, or Firm* — Philip D. Freedman, PC; Philip D. Freedman; Kenneth S. Wheelock

(57) ABSTRACT

A packet comprises at least two opposing sidewalls comprising a more rigid flat and a film pouch; and an expressing-shaped first closure end and a second closure end; the sidewalls and closure ends defining an enclosure; wherein at least the more rigid flat comprises a rigid material that can be folded or rolled to compress the enclosure to express a content through the expressing shaped closure end.

13 Claims, 5 Drawing Sheets

U.S. PATENT DOCUMENTS

| | | | | |
|---|---|---|---|---|
| 4,817,344 | A | 4/1989 | Wissinger | |
| 4,863,014 | A | 9/1989 | Simmons | |
| 4,974,732 | A | 12/1990 | Sullivan | |
| 5,034,455 | A | 7/1991 | Stein | |
| 5,180,063 | A | 1/1993 | Sakno | |
| 5,228,782 | A | 7/1993 | Imer | |
| 5,373,965 | A | 12/1994 | Halm et al. | 222/92 |
| 5,654,082 | A | 8/1997 | Kagawa | |
| 6,083,580 | A * | 7/2000 | Finestone et al. | 428/34.2 |
| 6,090,451 | A | 7/2000 | Barth | |
| 6,119,928 | A * | 9/2000 | Lasson et al. | 229/5.82 |
| 6,241,287 | B1 | 6/2001 | Best | |
| 6,269,654 | B1 | 8/2001 | Murray | |
| 6,305,132 | B1 | 10/2001 | Smith | |
| 6,305,577 | B1 | 10/2001 | Fillmore | |
| 6,451,440 | B2 | 9/2002 | Atwood | |
| 6,557,731 | B1 | 5/2003 | Lyon et al. | 222/94 |
| 6,659,278 | B1 | 12/2003 | Velliquette | |
| 6,662,948 | B1 | 12/2003 | Velliquette | |
| 7,241,066 | B1 | 7/2007 | Rosen et al. | 401/183 |
| 2001/0038020 | A1 | 11/2001 | Schalow | |
| 2001/0048198 | A1 | 12/2001 | Dulin | |
| 2001/0049427 | A1 | 12/2001 | Atwood | |
| 2003/0089625 | A1 | 5/2003 | Moodie | |
| 2004/0226968 | A1 | 11/2004 | LaFond | |
| 2005/0152624 | A1 | 7/2005 | Versluys | |
| 2005/0217034 | A1 | 10/2005 | Miller | |
| 2006/0226171 | A1 | 10/2006 | Sternberg | |
| 2007/0266901 | A1 | 11/2007 | Rance et al. | 106/501.1 |
| 2007/0272705 | A1 | 11/2007 | Beine et al. | 222/107 |
| 2008/0197042 | A1 | 8/2008 | Ullrich | |
| 2009/0110856 | A1 | 4/2009 | Gummaraju et al. | 428/35.7 |

OTHER PUBLICATIONS

ISR PCT 09/60541, Sep. 12, 2009, Momentive Performance Materials Inc.

* cited by examiner

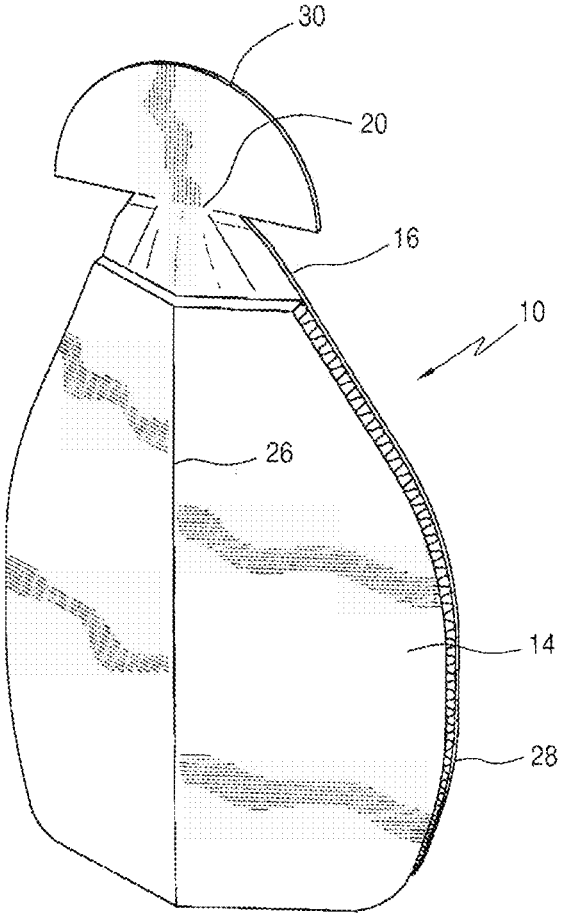
FIG. 1
FIG. 2
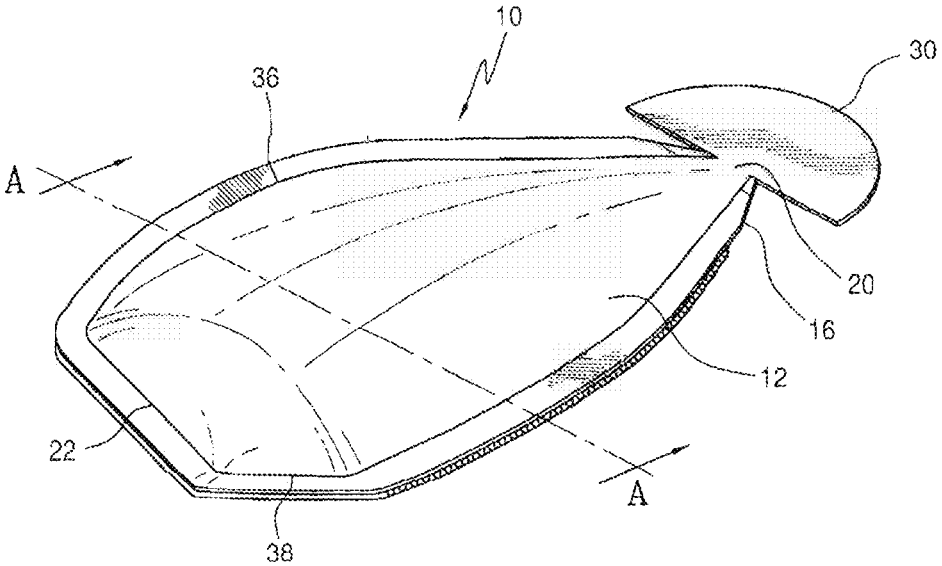

PACKET FOR VISCOUS MATERIAL AND KIT

This application is a continuation-in-part of U.S. application Ser. No. 11/613,661, filed Dec. 20, 2006, which is incorporated herein by reference in its entirety and this application is a continuation-in-part of U.S. application Ser. No. 12/200,376, filed Aug. 28, 2008 which claims benefit of provisional application 60/969,232 filed Aug. 31, 2007, which are incorporated herein by reference in their entirety.

BACKGROUND OF THE INVENTION

The invention relates to a packet, kit and method and more particularly to a packet, kit and method for dispensing a sealant.

Viscous materials include sealant, mastic, adhesive, glazing, caulk, grout and glue compositions. Viscous materials also include silicone sealants and caulks that are used in building and construction applications. Some of these compositions are referred to as room temperature vulcanizable (RTV) compositions. They may include a moisture-curable polyorganosiloxane polymer, filler and a condensation cure catalyst.

In one procedure, a quantity of sealant is directly expressed from a dispensing tube or cartridge to a crevice or other area in need of sealing. Typically, the dispensing tube or cartridge is unwieldy and difficult to use on small jobs. Also, the tube or cartridge usually contains more material than an amount required for a particular job and some unused portion of the tube contents remains after a required amount has been dispensed. A dispensing tube with, an unused portion is discarded or is saved for future use. Discarding is uneconomical and may be highly undesirable for environmental reasons. At present, there is no known recycling available for the wide variety of sealant compositions available on the market. If the container with residual sealant is not discarded, it is capped to save the material for future use. But, the sealant may include a volatile component that will evaporate to harden residual material. Other sealants may be settable from exposure to atmosphere oxygen. In these cases, unless the container is correctly reclosed, residual material will be lost.

Some dispensing containers are merchandised with a nozzle-engaging, snap-fit bead and grooved or screw threaded cap to provide a secure fit to the container body. But these caps are fragile pieces that, are easily split or otherwise damaged from over-tightening. Or, the snap-fit bead and groove may not provide an enduring reclose fit until the lime when the tube is next required for a caulk job. Some informal capping devices have included a nail that can be placed into the tube opening to effect a plug type reclosure. Or, the container cap may be merchandised with a plug member to provide this function. But, these solutions do not avoid content hardening for more than a short period of time.

Other reclosing approaches have included wrapping the container tip with aluminum foil or plastic wrap, securing with a rubber band and enclosing the entire container in a scalable plastic packet. But, oftentimes these mechanisms do not work because the packets rupture or the packets contain enough air to dry the tube contents. Additionally, a foil or wrap can not be closely and tightly fitted around the tube and nozzle without air gap.

There is a need for a viscous material dispensing mechanism that overcomes these problems of waste and difficulty of use. Also, there is a need for a reasonably priced solution to these problems.

BRIEF DESCRIPTION OF THE INVENTION

The invention provides a packet, method and kit to overcome current problems of waste, cost and difficulty of use.

In an embodiment, the invention is a packet for viscous material, comprising: a pouch comprising an expressing-shaped first closure end and a second closure end; a foldable flat cradling the pouch and comprising a material that is more rigid than the pouch and a crease extending longitudinally in the flat and along the pouch to facilitate folding or rolling the more rigid flat to compress the pouch to express a content through the expressing shaped closure end.

In another embodiment, a packet comprises a pouch having an expressing first closure end and a second closure end and a rigid flat, cradling the pouch; a reinforcing material at an expressing end of the packet that forms a funnel-shape to facilitate expressing of material from the pouch as a bead; wherein the rigid flat is substantially more rigid than the pouch and rigidity of the reinforcing material is intermediate between that of the flat and that of the pouch, wherein rigidity is determined by a stiffness test.

And in another embodiment, the invention is a method of applying a sealant, comprising: providing a packet comprising at least two opposing sidewalls comprising a more rigid flat and a film pouch; and an expressing-shaped first closure end and a second closure end; the sidewalls and closure ends defining an enclosure; wherein, at least the more rigid flat comprises a material that can be folded or rolled to compress the pouch to express a content through the expressing shaped closure end; and folding the more rigid flat to express the sealant from the packet to an exterior.

In yet another embodiment, the invention is a kit, comprising: an enclosure; a plurality of sealed packets contained within the enclosure, at least one packet comprising a pouch comprising an expressing-shaped first closure end and a second closure end; a foldable flat cradling the pouch and comprising a material that is more rigid than the pouch and a crease extending longitudinally in the flat and along the pouch to facilitate folding or roiling the more rigid, flat to compress the pouch to express a content through, the expressing shaped closure end; and a sealant contained within the at least one pouch.

Another embodiment is a method of applying a sealant, comprising: identifying a sealant job; determining an amount of sealant for the job to accomplish the job without substantial unused sealant; and selecting a packet from a kit of packets according to the determined amount of sealant.

And in another embodiment, the invention is a packet, comprising: at least two opposing sidewalls; a first closure end; and a second closure end; the sidewalls and closure ends defining an enclosure; and at least one closure end comprising an expressing shape comprising a reinforcing material, that forms a funnel-shape to facilitate expressing of material from, the enclosure as a bead.

Another embodiment is a method of applying a sealant, comprising: identifying a sealant job; determining an amount of sealant for the job to accomplish, the job without substantial unused sealant; and selecting a packet from a kit of packets according to the determined amount of sealant.

BRIEF DESCRIPTION OF THE DRAWING

FIGS. 1 and 2 are schematic perspective views of a packet, front and back;

DETAILED DESCRIPTION OF THE INVENTION

The term "sealant" as used herein includes an entire variety of caulks including silicones, latex and acrylic caulk; filler compounds; adhesive or mastic-type materials, such as stucco, concrete and cementious-material patching and crack filling compounds; gasketing compounds; gutter, flashing, skylight, or fish tank seam or sealant compounds; butyl or rubber sealants, cements and caulk; roof cements; panel and construction adhesives; glazing compounds and caulks; gutter and lap sealants: silica gel-based firebrick, masonry and ceramic crack fillers and cements; silicone-based glues; ethylene glycol-containing latex glazing compounds; and the like.

One preferred sealant is an organopolysiloxane room temperature vulcanizable (RTV) composition. The room temperature vulcanizable silicone elastomer composition can contain a silanol stopped base polymer or elastomer, reinforcing and/or extending filler, cross-linking silane and cure catalyst. These RTV compositions are prepared by mixing diorganopolysiloxanes having reactive end groups with organosilicon compounds that possess at least three hydrolyzably reactive moieties per molecule. The known RTV compositions are widely used as elastic sealing materials for applications involving the gaps between various joints such as: gaps between the joints of structures; joints between structural bodies and building materials in buildings; gaps between a bathtub and wall or floor; cracks on tiles in bathrooms; gaps in the bathroom such as those around the washbasin and those between a washbasin supporting board and a wall; gaps around a kitchen sink and the vicinity; spacings between panels in automobiles, railroad vehicles, airplanes and ships; gaps between prefabricated panels in various electric appliances, machines; and the like. Room temperature vulcanizable silicone sealants thus may be utilized, in a wide variety of caulking and sealing applications.

Features of the invention will become apparent from the drawings and following detailed discussion, which by way of example without limitation describe preferred embodiments of the invention.

Figure 3:
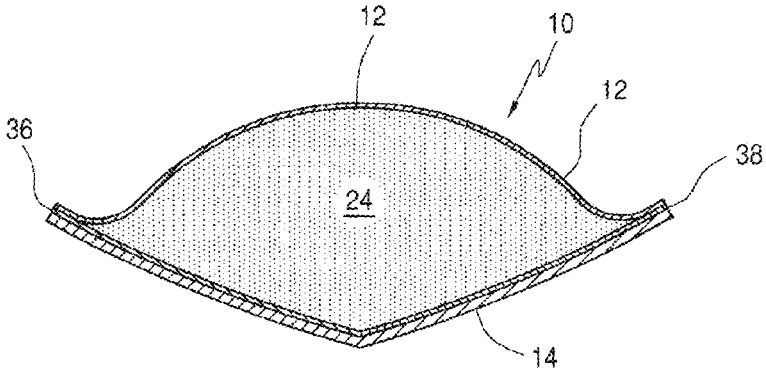
FIG. 3 is a cut-away view through A-A of the FIG. 2 packet.
Figure 4:
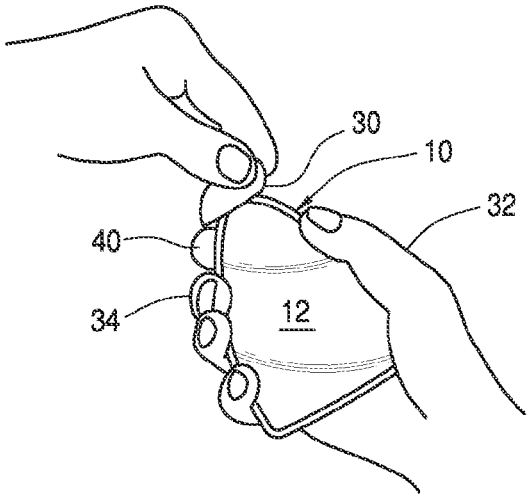

FIG. 1, FIG. 2 and FIG. 3 illustrate an embodiment of the invention. FIGS. 1 and 2 are schematic perspective views of a packet, front, and back and FIG. 3 is a cut-away view through A-A of the FIGS. 1 and 2 packet. FIG. 1 is a front view of the packet 10. FIG. 2 is a perspective of the packet 10 from a back side. FIG. 3 is a cut away side view of the packet 10. The size of packet 10 can vary, but in some embodiments can be about 20 cm by 15 cm or smaller.

The packet 10 comprises a pouch 12 of plastic or foil film, a rigid flat 14 comprising a more rigid or thicker material than the pouch 12 film and a spout-forming area 16 on the rigid flat 14 side of the packet 10. The area 16 comprises a shaped material of intermediate thickness and rigidity between that of the material of the pouch 12 and the material of the flat 14. In the embodiment shown in the figures, area 16 is trapezoidal-shaped with slanted sides from the rigid material sidewall 14 toward the packet tip end 20 that forms a tapered nozzle when folded or rolled with the rigid flat 14.

Figure 5:
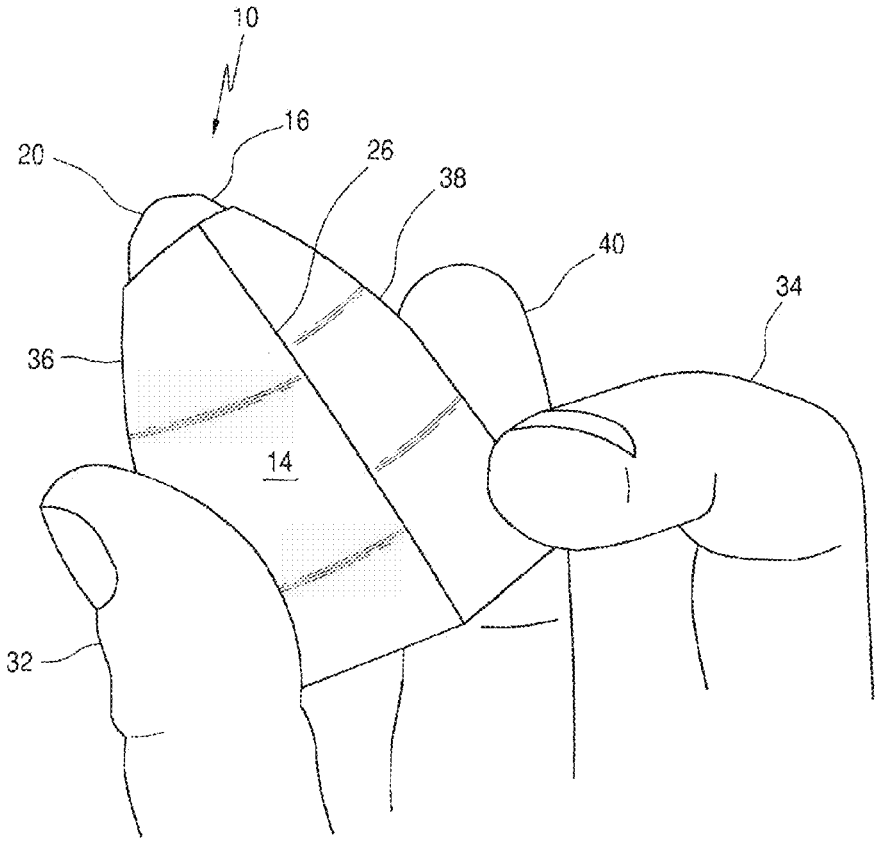
FIGS. 4, 5, 6, 7, 8 and 9 are schematic perspective views of use of the packet.

The pouch 12 can be heat-sealed or otherwise cradled to the flat 14 as shown in FIG. 3. A first closure end of pouch 12 forms an expressing shape tip 20. In FIGS. 1, 3 and 5, the more rigid flat 14 has crease 26 that can be a fold or score running along the longitudinal axis of the more rigid flat 14 from tip 20 to a second closure end 22. The crease 26 is marked into the flat 14 surface to facilitate longitudinal folding of the packet 10, as hereinafter described. The crease 26 can be a pressed, folded, wrinkled, embossed line or score. The crease 26 can run generally longitudinal to a long axis of the packet 10 from one end of the packet 10 toward the tip end 20.

The packet 10 further includes a semicircular-shaped tear tab 30 to facilitate opening at the tip 20. The top film 12 can be pleated 28 to allow for an increased volume of a sealant 24.

The crease 26 promotes longitudinal folding of opposite rigid flat sections against the pouch 12 to compress the pouch 12 to express sealant 24 from the pouch 12 interior. The more rigid flat 14 comprises a rigid or conformable surface that is configured to form cradling compression surfaces against pouch 12 when folded by a force applied to rigid flat 14 opposite sections as hereinafter described. The more rigid flat 14 can be a flat comprising any material that is more inflexible or rigid than the pouch 12 material. An area 16 on the rigid flat 14 side of the packet 10 comprises a shaped strip of intermediate thickness and rigidity between the material of the pouch 12 and the material of the flat 14.

Materials suitable for pouch 12 include single layer, coextruded or laminated film or foil. Preferably the material has a permeability rating of 1 or lower. Suitable film materials include a plastic film, such as low-density polyethylene or other thermoplastic or foil film material such as polypropylene, polystyrene or poly-ethylene-terephtalate. The foil is a thin, flexible leaf or sheet of metal such as aluminum foil for example. In one embodiment, the film is a polyethylene and bioriented polypropylene coextruded film. An aluminum foil is a preferred pouch 12 film material. Suitable foil can be derived from aluminium prepared in thin sheets with a thickness less than 0.2 mm/0.008 in, although much, thinner gauges down to 0.006 mm can be used. A suitable foil can comprise a laminate with other materials such as a plastic or paper.

The pouch 12 material can be impermeable or only slightly permeable to water vapor and oxygen to assure content viability. For example, the film can have a moisture vapor transport rate (MVTR, ASTM D3833) of less than 10 g/day/$m^2$. In an embodiment, the MVTR of the film is less than 5 g/day/$m^2$ and preferably less than 1 g/day/$m^2$ and most preferably of less than 0.5 g/day/$m^2$. The pouch 12 film can be of various thicknesses. The film thickness can be between 10 and 150 μm, preferably between 15 and 120 μm, more preferably between 20 and 100 μm, even, more preferably between 25 and 80 μm and most preferably between 30 and 40 μm.

The more rigid flat 14 comprises a substantially rigid substrate with a fold-imparting crease 26 or a substantially conformal substrate that can be rolled or folded against the pouch 12. The rolling or folding compresses the pouch 12 to cause sealant 24 to be expressed from pouch 12 interior through a nozzle formed at the tip end 20. The material of the more rigid flat 14 is substantially inflexible and less compliant than the material of top film 12. In this application, the term "rigid" means having the physical property of being stiff and resistant to bending. In an embodiment, the bottom material 14 is more rigid as measured in accordance with a Taber Stiffness method such as the ASTM D1044 Taber test.

The flat 14 can comprise any suitable rigid or semi-rigid material such, as cardboard, paperboard, corrugated board and any wood-based type of paper or rigid or semi-rigid plastic sheet material. Cardstock is a suitable more rigid material. Cardstock thickness is often described by pound weight. Pound weight is the weight of 500, 20" by 26" sheets. In the US, cardstock thickness is usually measured in points or mils that gives the thickness of the sheet in thousandths of an inch. For example, a 10 pt. more rigid flat is 0.010 inches thick; 12 pt. is 0.012 inches.

The flat 14 can comprise a combination of paperboards, usually two flat pieces of paper and one inner fluted corrugated medium. Further suitable more rigid flat materials include stiff paper, cardboard, pasteboard or paperboard including corrugated paperboard and polyethylene such as 0.0015 inch high density polyethylene. The more rigid flat 14 can comprise a substantially rigid material such as a thermoplastic, for example ABS (acrylonitrile-butadiene-styrene). One preferred flat 14 material is a paperboard that is 10 mils or 0.01.0 inches in thickness or greater.

Corrugated fiberboard is a preferred material for flat 14. Corrugated fiberboard has two main components: a linerboard and a medium. Both can be made of a heavy paper called container board. Linerboard is a flat, facing that adheres to the medium. The medium is typically an inner fluted corrugated, maternal. The corrugated board can be one medium glued to one flat sheet of linerboard, a medium between two sheets of linerboard and even three sheets of linerboard with two mediums between. The fluted medium forms rigid arched columns that can resist bending and pressure from, all directions. It has been found that a corrugated board serves especially well as a flat to cradle a sealant-filled pouch to aid in expressing sealant as hereinafter described with reference to FIGS. 5 through 9.

In embodiments, the pouch 12 comprises a multilayer polymer laminate along with an aluminum layer having a thickness between about 0.0045 and about 0.0065, preferably about 0.0055 inches. The area 16 comprises high density polyethylene (HDPE) having a thickness between about 0.012 and 0.018 inches, preferably about 0.015 inches. The rigid material 14 comprises corrugated fiberboard having a thickness between about 0.045 and 0.060, preferably between 0.050 and 0.055 inches. The suitable pouch 12, flat 14 and area 16 materials can be subject to the proviso that the rigidity of the flat 14 material is greater than that of the pouch 12 material and the rigidity of area 16 material is intermediate between that of the pouch 12 and that of the flat 14 materials.

Figure 7:
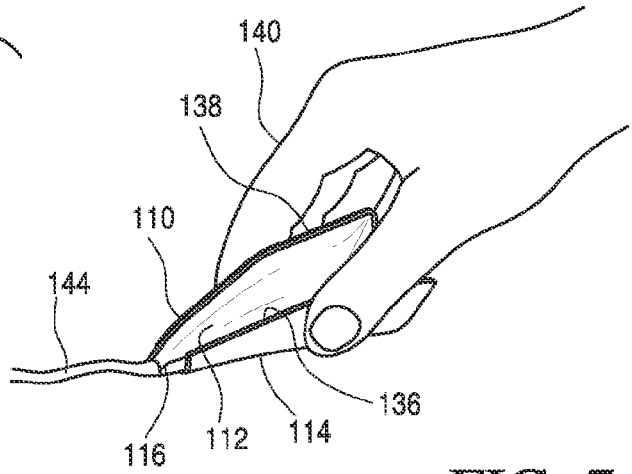
Figure 6:
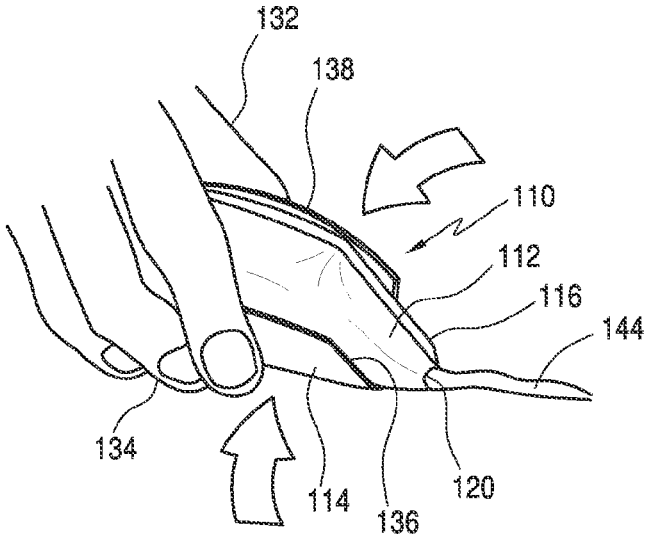
Figure 8:
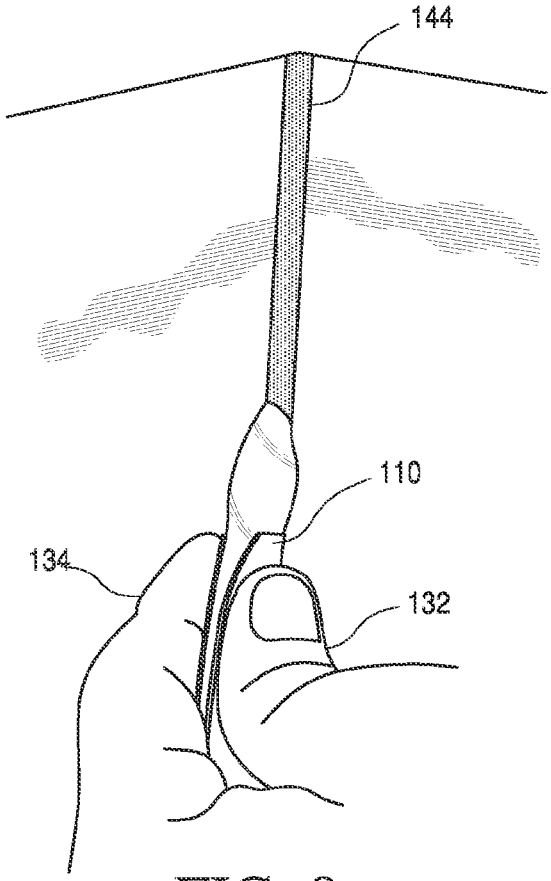
Figure 9:
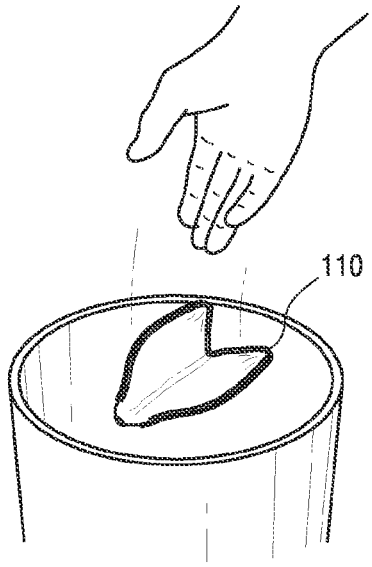

FIGS. 7, 8 and 9 are schematic perspective views illustrating a use of a packet embodiment 110. In FIGS. 6 and 7, the packet 110 is held in one hand. In applying a viscous material such as a caulk, the packet 110 can be grasped by hand with pouch 112 side up as shown in FIGS. 7 and 8. Thumb 132 and second finger 134 are located on opposing edges 136, 138 of a more rigid flat 114. Index finger 140 is impressed against pouch 112 toward crease 126 to commence folding of more rigid flat 114. With the force applied by thumb 132 and second finger 134 to opposing edges 136, 138, the packet 110 begins to fold along crease 126. Folding can be facilitated by a user imposing the length of an index finger against the pouch 112 while the side force is applied by thumb 132 and second finger 134. In this example, more rigid flat 114 comprises a substantially rigid material with planar face underlying the pouch 112 that cradles the pouch 112 as more rigid flat 114 is folded along crease 126 as shown in FIG. 6.

As shown in FIGS. 6, 7 and 8, the folding drives enclosed sealant from within pouch 112 up through tip-shaped first closure end 120 as shown in FIG. 6. Initially, the sealant can be contained within the pouch 112 of the packet 110 and the shaped area 116 will be flat and devoid of sealant. But, as the packet 110 is folded and pressed as shown in FIG. 6 the sealant is forced into area 116. The area 116 folds and forms an expressing tip shape. The substantially rigid structure formed from the over-folding of two sides of the packet 110 can be firmly held and guided to express a controlled sealant bead 144 from area 116 as shown in FIGS. 6, 7 and 8. The area 116 is shaped to allow sealant 144 to fill the rest of the tip and flow from the tip. The area 116 can be shaped to an appropriate bead size 144, for example, $\frac{1}{8}^{th}$ inch in diameter. A user can further regulate bead size 144 by applied pressure and speed as illustrated in FIGS. 6, 7 and 8. Once sealant has been applied and the pouch 112 voided of material, the empty packet 110 can be discarded as illustrated in FIG. 9.

Figure 10:
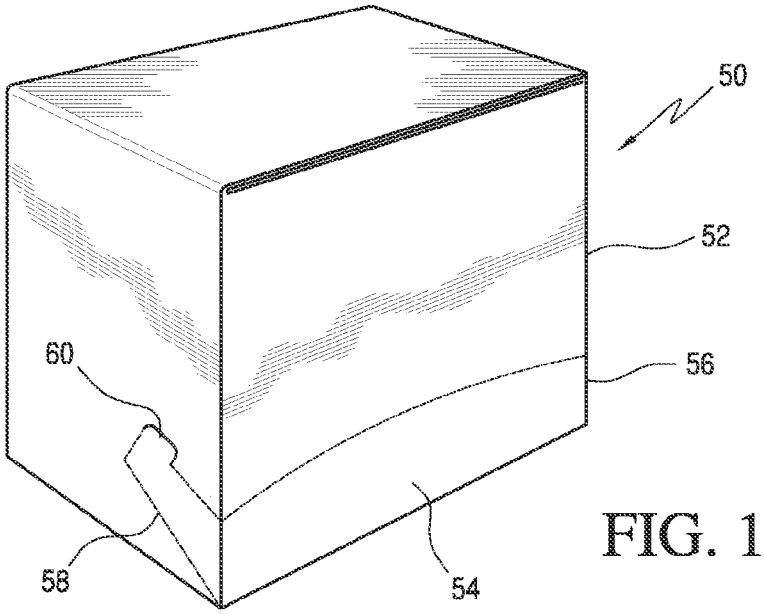
FIG. 10 is a perspective view of a kit with a plurality of packets.
Figure 11:
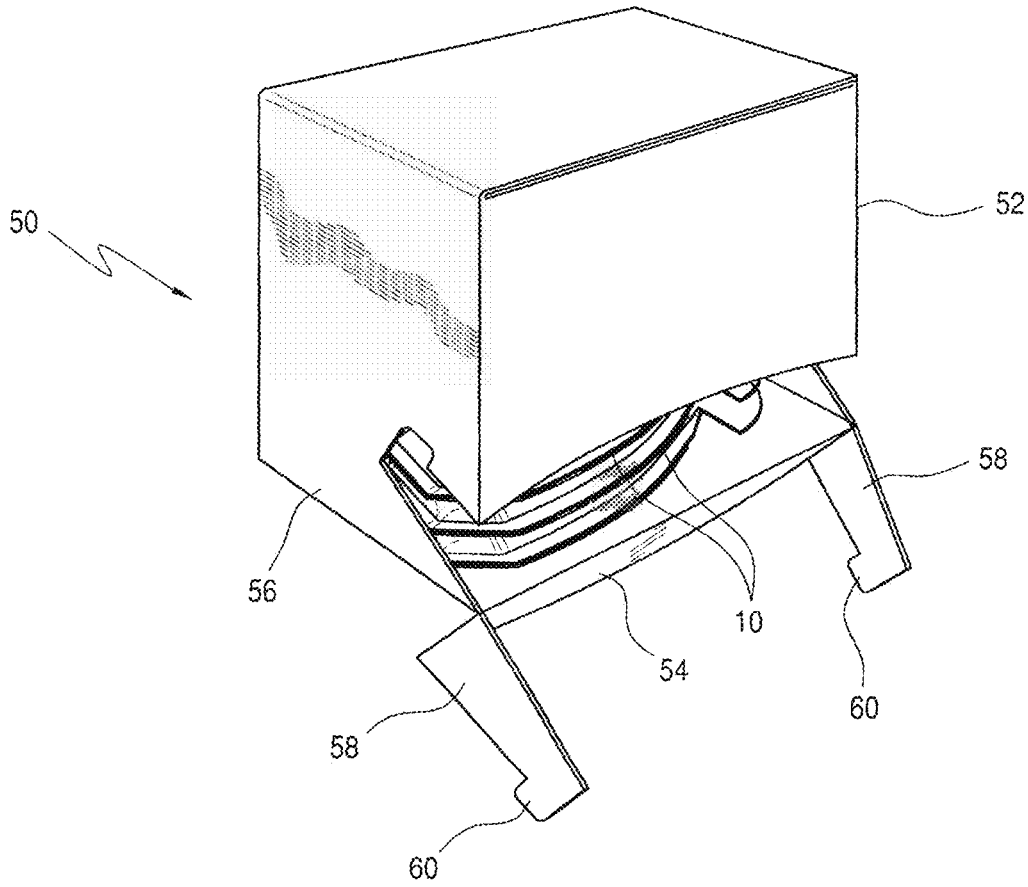

FIG. 10 illustrates an embodiment of the invention wherein a plurality of packets 10 are provided in a kit 50. The kit 50 includes an enclosure 52, which is a box-shaped structure with a "punch-out" section 54 comprises a wall section 56 of the box with extending fingers 58 having securing tab ends 60 defined on either side of the enclosure 52. The "punch-out" section 54 is defined into the structure 52 by serrated embossing that is separated from the structure 52 and folded outwardly to present the box contents as shown in FIG. 11. The box is sealed at the top for transportation but the top can be removed to further present the kit 50 packet 10 content as shown in FIG. 11. The contents comprise a plurality of packets 10. The plurality of packets 10 can be the same shape or a variety of shapes or the same size or a variety of sizes, for example 8 cm×6 cm or 4 cm by 2 cm to provide measured amounts of sealant for a variety of jobs. The kit 50 can provide a variety of sized packets 10 so that one packet 10 can be selected to match the requirements of any particular job.

A selected packet from a kit of the invention can provide a desired amount of sealant for any particular job. No caulk, gun is needed to apply the sealant. Indeed, no extra tools or materials are needed. The packet is relatively small and easily maneuverable to apply an appropriate bead. The packet requires little application of force for dispensing and in most instances, sealant can be fully dispensed by one hand. Saving left over caulk is eliminated. Both kit and packet packaging are inexpensive.

EXAMPLES

In this evaluation, each user squeezed a caulk-containing packet with one hand. Users then rated the packets on accurate dispensing, percent of dispensing and ease of use. The packets were evaluated accordingly and also according to manufacturability and cost.

Example 1

This EXAMPLE describes a series of iterative evaluations of packet samples to determine a best more rigid material.

First; a range of materials including a paperboard, plastic sheet and corrugated fiberboard were evaluated for output performance. Sample paperboard thickness was varied from approximately 0.010" to 0.100"; a high density polyethylene sheet (HDPE) was varied in thickness from approximately 0.005" to 0.100"; and a corrugated fiberboard corrugation was varied from B flute to N flute.

User ratings determined that a paperboard with a thickness less than approximately 0.080" did not have sufficient stiffness for acceptable dispensing and "ease of use." A thicker paperboard gave improved performance results but was rated unacceptable because of bulky feel. Thinner HDPE samples below 0.040" in thickness, were rated unacceptable because of insufficient stiffness. Thicker HDPE samples showed improved performance but increased cost.

Performance for corrugated fiberboard was best in the E- and F-flute range. The letter designation relates to flute size or refers to the number of flutes per lineal foot. An E-flute has 90+/−4 flutes per lineal foot, and a flute thickness of 1/16 inch and an F-flute has 128+/−4 flutes per lineal foot and a flute thickness of 1/32 inch. The E-fluted and 1-fluted corrugated fiberboard packets had a single handed use dispensing percentage of approximately 80% and greater. The E-flute corrugated fiberboards also received the best "ease of use" ratings.

Example 2

Another series of tests was conducted to determine a best performing packet in terms of sealant bead shape. A standard bead was defined as a deposit of sealant with a circular cross section.

First tested packets had only a top film pouch and thicker bottom material sidewall. The thicker material sidewall was folded to form a nozzle. However, the nozzles formed from the folded sidewall were flexible and formed a non-uniform bead. A bead cross section would initiate in a shape of a thin horizontal diamond. Then later in the dispensing, the bead cross section would be formed in the unacceptable shape of a thin vertical diamond. Furthermore, tire top film tended to form sharper folds and creases at the nozzle, making the cross section less uniform.

In the tests of this EXAMPLE, a semi-rigid material, was added to one sidewall adjacent to the packet tip end. In these EXAMPLES, when the more rigid material sidewall was folded along its longitudinal axis to squeeze the pouch, the semi-rigid material bent in a controlled manner to a substantially U-expressing shape. The U-expressing shape ensured that one half of the cross section, was more uniform and round and constrained edges of the flexible sidewall to provide a uniform and round, expressed bead.

Example 3

HDPE was selected as a cost-acceptable material for a top film pouch. The HOPE was found to adhere to the rigid, foldable sidewall material. In expressing tests, the HDPE materials cooperated with the U-expressing shape in forming a desirable cross section bead. Optimum HDPE was determined through a series of experiments on 0.005" to 0.030" thick HDPE. A 0.015" thickness was found to have the best performance of that range of materials in forming bead cross section.

While preferred embodiments of the invention have been described, the present invention is capable of variation and modification, and therefore should not be limited to the precise details of the Examples. The invention includes changes and alterations that fall within the purview of the following claims.

What is claimed is:

1. A packet for viscous material, comprising:

a pouch comprising an expressing-shaped first closure end and a second closure end and at least two opposing sidewalls; the closure ends and sidewalls defining an enclosure, and at least one closure and comprising an expressing shape;

a separate rigid foldable flat cradling the pouch and comprising a material that is more rigid than the pouch;

a spout-forming area separate from the pouch and the rigid foldable flat and positioned on a rigid foldable flat side of the packet and of intermediate rigidity or thickness to the pouch and the rigid foldable flat, wherein the spout-forming area reinforces at least a part of the pouch at the pouch expressing shape first closure end and wherein the separate rigid foldable flat overlaps the spout-forming area to cradle the spout-forming area with the cradled pouch; and a crease extending longitudinally in the flat and along the pouch to facilitate folding or rolling the more rigid flat to compress the pouch with the spout-forming area to express a content through the expressing-shaped first closure end.

2. The packet of claim 1, wherein the more rigid flat comprises the crease extending along the pouch between the two closure ends to facilitate folding or rolling the rigid flat and wherein the crease is a longitudinal divide in the rigid flat sections configured to form cradling compression surfaces against the enclosure.

3. The packet of claim 1, wherein the more rigid flat comprises a stiff paper, cardstock, fiberboard or thermoplastic material.

4. The packet of claim 1, wherein the more rigid flat comprises corrugated fiberboard having a thickness between about 0.045 and 0.065.

5. The packet of claim 1, wherein the more rigid flat comprises a fluted corrugated medium sandwiched between flat paper pieces.

6. The packet of claim 1, wherein the pouch is filled with a moisture-curable polyorganosiloxane polymer, filler and condensation cure catalyst and the pouch comprises permeability rated film, of 1 or lower.

7. The packet of claim 1, wherein the pouch contains sealant and comprises a plastic or foil film material.

8. The packet of claim 1, wherein the spout-forming area is trapezoidal-shaped with slanted sides toward the expressing-shaped first closure end to form an expressing shaped nozzle when folded or rolled with the rigid flat.

9. The packet of claim 1, herein the rigid flat is substantially more rigid or thicker than a pouch material and rigidity or thickness of material of the spout-forming area is intermediate between that of the pouch material, wherein rigidity is determined by a Taber stiffness test.

10. The packet of claim 1, comprising a pouch having dimensions of 20 cm to 4 cm by 15 cm to 2 cm with a filled thickness of 0.5 cm to 2 cm.

11. The packet of claim 1, comprising a pouch that holds a sealant.

12. The packet of claim 1 wherein the rigid flat is substantially more rigid than the pouch and rigidity of the reinforcing material is intermediate between that of the flat and that of the pouch, wherein rigidity is determined by a stiffness test.

13. A kit, comprising:

an enclosure; and a plurality of sealed packets according to claim 1, contained within the enclosure each packet containing a sealant.

* * * * *